US005123318A

United States Patent [19]

Su et al.

[11] Patent Number: 5,123,318

[45] Date of Patent: Jun. 23, 1992

[54] PAPERBOARD CUTTING MACHINE

[76] Inventors: Shun-Fa Su, No. 10, Alley 28, Lane 917, Kang Shan South Street Chien Chen District, Kaohsiung; Ching-Chuan Lin, No. 22-3, Lane 80, Wu Ching 2nd Rd., Feng Shan City, Kaohsiung County, both of Taiwan

[21] Appl. No.: 802,410

[22] Filed: Dec. 4, 1991

[51] Int. Cl.[5] ..... B26F 1/42

[52] U.S. Cl. ..... 83/289; 83/284; 198/817

[58] Field of Search ..... 83/284, 613, 424, 659, 83/292, 290, 435.2, 285, 155, 409; 493/372, 369; 198/817

[56] References Cited

U.S. PATENT DOCUMENTS 4,086,834 5/1978 Shields ..... 83/284 X 4,643,062 2/1987 Highfield et al. ..... 83/284 X 4,860,622 8/1989 DiBernardo ..... 83/284 X

*Primary Examiner*—Frank T. Yost

*Assistant Examiner*—Kenneth E. Peterson

*Attorney, Agent, or Firm*—Morton J. Rosenberg; David I. Klein

[57] ABSTRACT

A paperboard cutting machine which includes a main unit, two locating tables separately at two sides of the main unit, and a movable template having cutter bearings fixed thereon. The movable template is allowed to reciprocally move over the two locating tables and therefore allows paperboard put on the cutter bearings to be pressed and but into desired pattern by two cylindrical rollers in the main unit. Different sizes of paperboards may be cut on such paperboard cutting machine in mass production while the machine can be operated much safer even by inexperienced workers.

3 Claims, 3 Drawing Sheets

PAPERBOARD CUTTING MACHINE

BACKGROUND OF THE INVENTION

Due to incompletion in structural designs, most conventional paperboard cutting machines could be used to cut paperboards in smaller sizes only; for paperboards in larger dimensions, it is difficult to cut them into desired pattern by only one step. Moreover, what is to be noted is most conventional paperboard cutting machines require skilled and experienced workers or operators to feed paperboards to be cut and to collect cut paperboards lest the workers' hands should be carelessly injured during operation of the machines.

SUMMARY OF THE INVENTION

It is a primary object of the present invention to provide an improved paperboard cutting machine of which a movable template onto which cutter bearings are fixed is reciprocally movable on and between two locating tables separately at two sides of the main unit of the cutting machine; paperboard put over the cutter bearings may then be adequately pressed by two cylindrical rollers of the main unit when the movable template moves through there, and thereby be cut into desired pattern.

With such cutting machines, paperboards may be cut into desired patterns by mass production on safely operated machines while the manufacture and replacement of cutters is rather simple.

BRIEF DESCRIPTION OF THE DRAWINGS

The structural setup of the present invention and the functions and performance thereof can be better understood by referring to the following detailed description of the preferred embodiments and the accompanying drawings wherein.

DETAILED DESCRIPTION OF THE PREFERRED EMBODIMENTS

Figure 1:
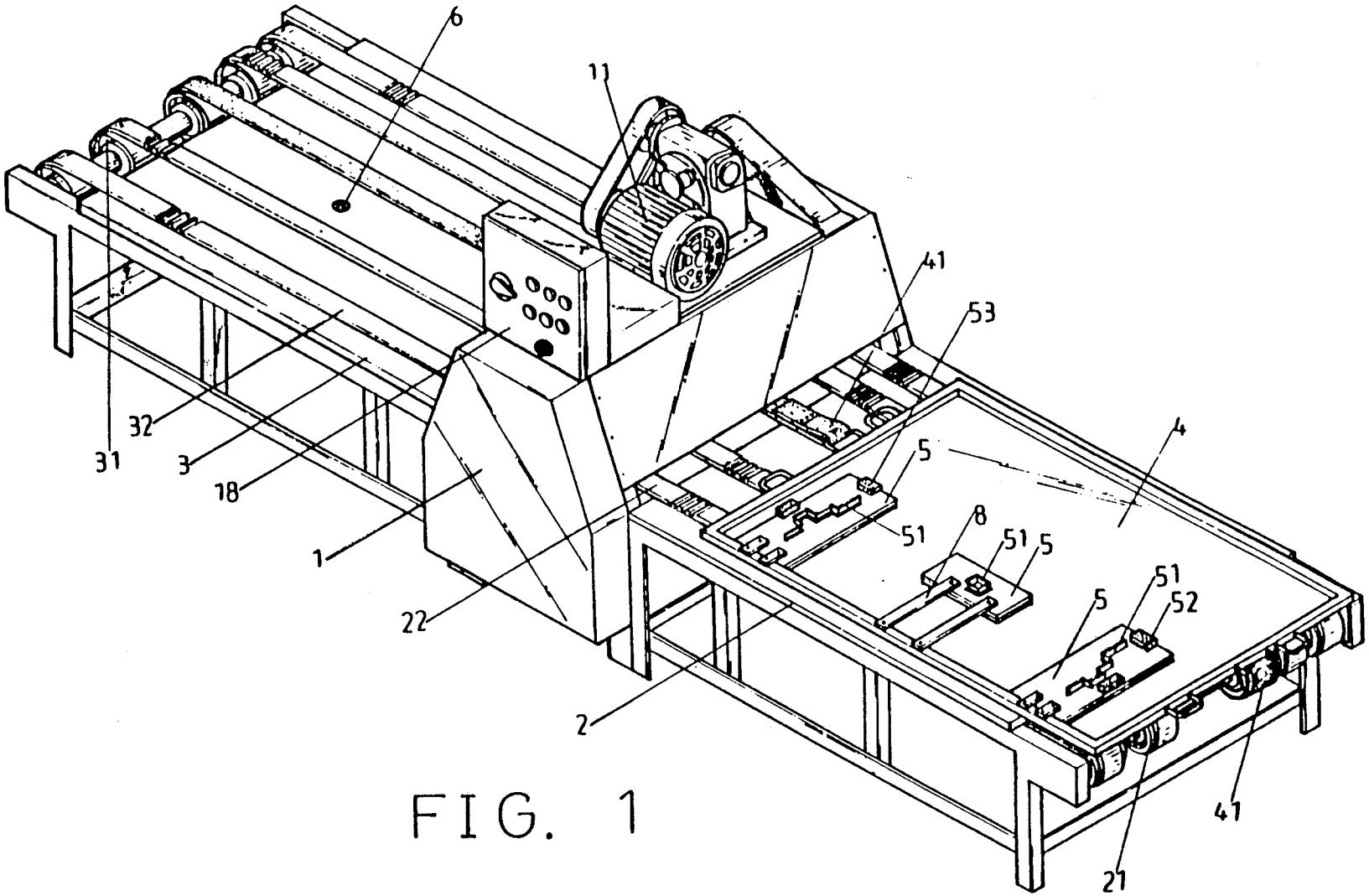
FIG. 1 is a three-dimensional perspective of the present invention.
Figure 2:
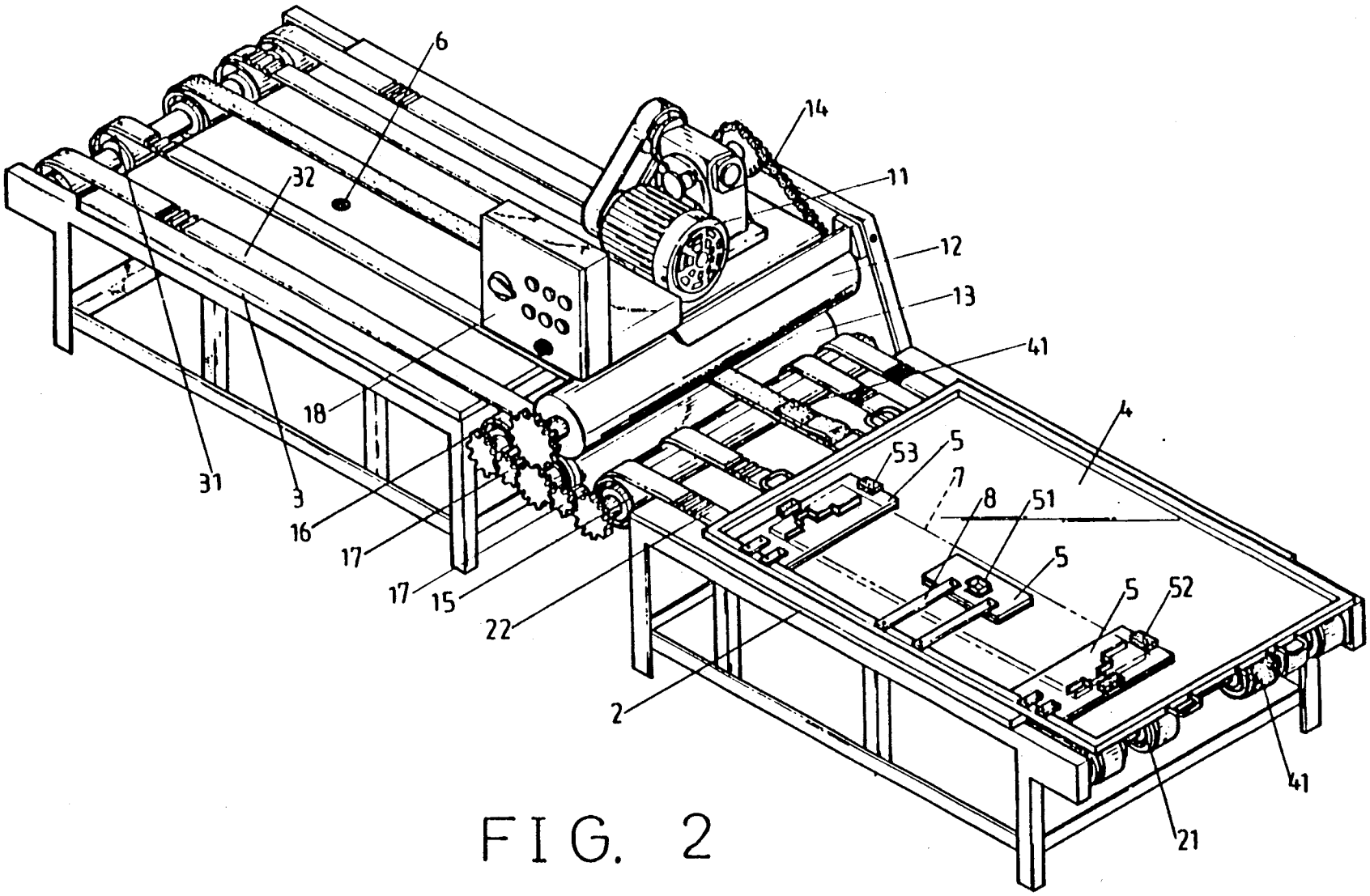
FIG. 2 is also a three-dimensional perspective of the present invention in which the main unit thereof is disclosed to show the components therein and the way in which such components interact with other parts of the present invention.

Please refer to FIGS. 1 and 2. The present invention mainly includes a main unit 1, two locating tables 2, 3 separately at two sides of the main unit 1, a generally plane-board-like movable template 4, and a set of cutter bearings 5 fixed onto the movable template 4 at adequate positions.

The main unit 1 has a motor 11, an upper cylindrical roller 12 and a lower cylindrical roller 13 properly spaced with each other and both located below the main unit 1 at proper position, two side-rollers 15, 16 separately at each side of the lower cylindrical roller 13 and engaging with the latter with a gear 17, and a control box 18 located beside the motor 11 functioning as a timer to control the positive or reverse turning or stop of the motor 11. The wiring of the control box 18 is a known art and therefore is not described herein. The motor 11 connects and thereby drives the upper cylindrical roller 12 with a chain 14. The lower cylindrical roller 13 engages with the upper cylindrical roller 12 with gears.

The locating tables 2, 3 are generally two frameworks and separately located at outer side of the two side-rollers 15, 16. A plurality of pulleys 21, 31 are respectively provided on the outer end of the locating tables 2, 3, anti-slip leather belts 22, 32 are used to wind outside of each pulley 21, the locating table 2, and the side-roller 15, and each pulley 31, the locating table 3, and the side-roller 16, respectively. An electric eye 6 is provided on each locating table 2, 3 at proper position and electrically connects with the control box 18 of the main unit 1.

The movable template 4 is designed to be in proper size suitable for being positioned on top of one of the locating tables 2, 3 and over the anti-slip leather belts 22, 32. The anti-slip leather belts 22, 32 have uneven outer surface to increase the friction when it contacts the movable template 4. A fastening belt 41 longitudinally fixed to the movable template 4 at proper points on two outer edges thereof is further used to wrap a proper set of pulleys 21, 31 in such a manner that the movable template 4 may be driven to move over the locating tables 2, 3 by the anti-slip leather belts 22, 32 and passes between the upper and the lower cylindrical rollers 12, 13. In other words, the movable template 4 is allowed to move back and forth on the locating tables 2, 3.

The cutter bearings 5 are formed of several replaceable members which are cut into shapes according to the desired paperboard patterns. Each set of cutter bearings 5 is fixed onto the movable template 4 at proper position with connection members 8. In a preferred embodiment as illustrated in FIG. 2, the cutter bearings 5 are designed and positioned in such a manner that a paperboard 7 thereon can be cut to have openings separately formed at two outer edges and near middle.

Cutters 51 used on the members of cutter bearings 5 may have pads (no shown) made of sponge material provided around their periphery. With these pads, the cutters 51 will not trap in the cut paperboard 7 and therefore facilitates the collection of cut paperboard 7 from the movable template 4.

Locating members 52, 53 made of compressible sponge material are selectively provided at adequate position on the members of cutter bearings 5 set at two outer edges of the paperboard 7 to be cut so that the paperboard 7 to be cut may be put in place before being processed (as shown in FIG. 2).

Figure 3:
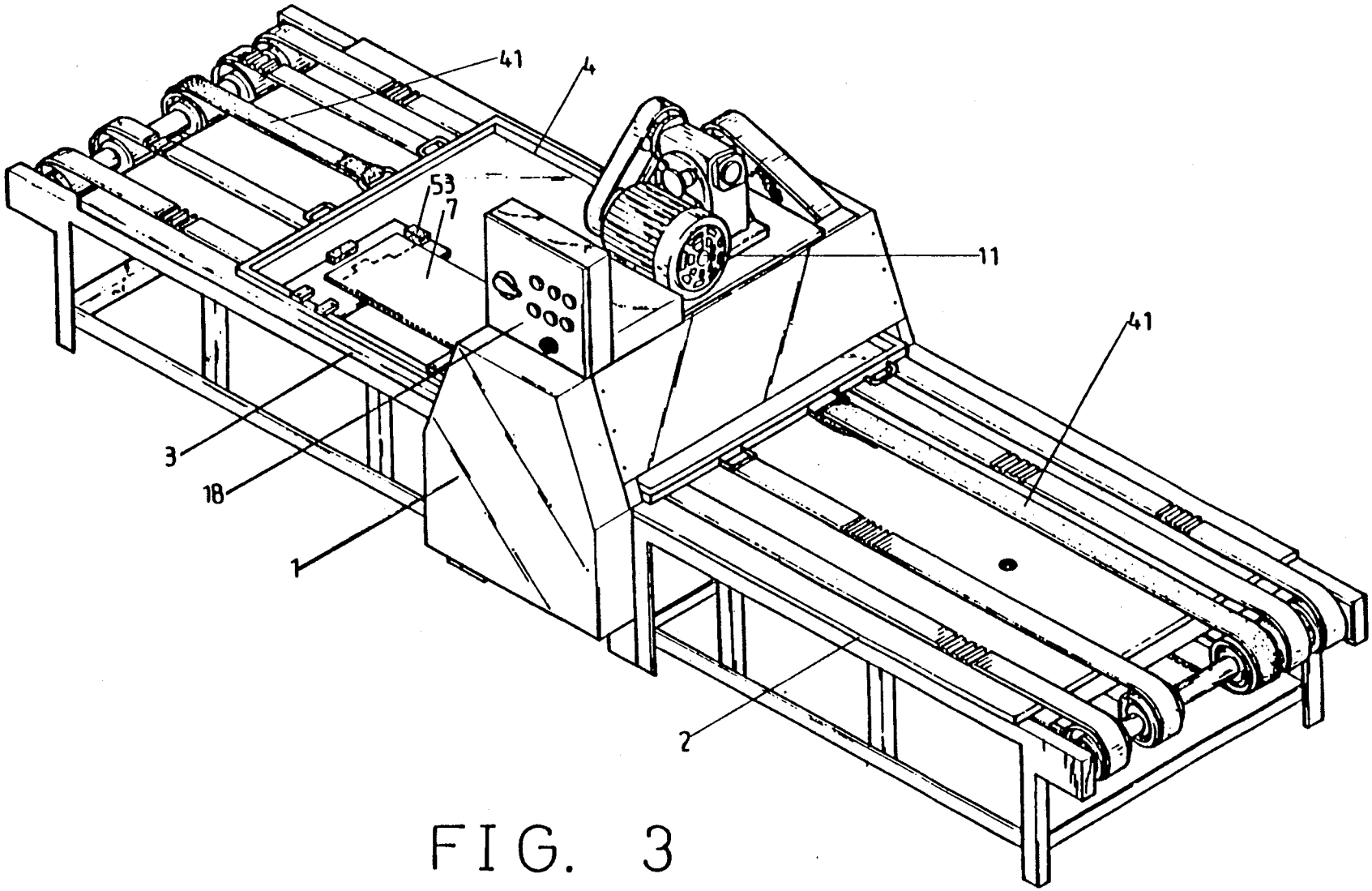
FIG. 3 illustrates an preferred embodiment of the present invention.

Please further refer to FIGS. 2 and 3. In operation of the present invention, first position and fix the cutter bearings 5 which are pre-cut to desired shapes to proper places on the movable template 4. The thickness of the members of the cutter bearings 5 is properly set in advance and is adjustable to match with the gap between the upper and the lower cylindrical rollers 12, 13. Then, put the paperboard 7 over the cutter bearings 5 between the locating 52, 53 before starting the motor 11 to gear the upper and the lower cylindrical rollers 12, 13 and the side-rollers 15, 16. The motor 11 will drive the anti-slip leather belts 22, 32 and the fastening belt 41 which together cause the movable template 4 to move from the locating table 2 through the gap between the upper and the lower cylindrical rollers 12, 13 to the locating table 3. When the paperboard 7 passes the gap between the upper and the lower cylindrical rollers 12, 13, it is pressed by the two rollers 12, 13 and therefore, cut to the desired pattern by the cutters 51 on the cutter bearings 5. When the movable template 4 moves to the locating table 3 and passes the electric eye 6 thereon and is sensed by the same, a signal is sent by the electric eye 6 to the control box 18 which causes the motor 11 to stop running. At this point, the movable template 4 stops at the outer side of the locating table 3 for a preset period of time, allowing the collection of cut paperboard 7 and the feeding of a new paperboard 7 to be cut. After the preset period of time, the motor 11 starts again and turns in reverse direction, causing the movable template 4 to move toward the locating table 2. When the new paperboard 7 passes the upper and the lower cylindrical rollers 12, 13, it is cut into desired pattern. Then, when the cut paperboard 7 reaches the electrical eye 6 on the locating table 2 and is sensed by the same, the motor 11 stops on receipt of a signal sent by the electrical eye 6 to the control box 18 again. With this reciprocating movement of the movable template 4 on the locating tables 2, 3, paperboards 7 may be rapidly cut to desired pattern in mass production.

Following improved effects and advantages can be achieved by operation of the present invention:

1. The cutting machine can be widely used to cut paperboards in either large or small size.
2. Paperboards are fed and collected in horizontal direction which is much simpler and safer and does not require skilled and experienced workers to operate.
3. Noises and vibrations produced by the rollers during the process of pressing are much reduced.
4. The cutter bearings 5 can be easily manufactured with low cost.
5. Paperboards can be cut to desired patterns in mass production.

What is claimed is:

1. A paperboard cutting machine comprising a main unit, two locating tables separately set at two sides of said main unit, a generally plane-board-like movable template suitable for laying over said locating tables, and a set of cutter bearings being properly located and fixed on said movable template;

said main unit consisting of a motor, an upper cylindrical roller below said motor and connecting with said motor with a chain, a lower cylindrical roller below said motor while being adequately spaced from said upper cylindrical roller and engaging with the same with gears, two side-rollers separately provided at two sides of said lower cylindrical roller and connecting with said lower cylindrical roller with gears;

said locating tables being separately provided at outer sides of said two side-rollers of said main unit, each having a plurality of pulleys provided at an outer end away from said main unit and a plurality of anti-slip leather belts each of which circling one of said pulleys, one of said locating tables, and one of said side-rollers adjoining said locating table;

said movable template being designed to proper size suitable for being positioned on said locating tables over said anti-slip leather belts and having a fastening belt longitudinally fixed to two outer edges of said movable template; said fastening belt further circling said two locating tables and two corresponding pulleys separately on said two locating tables;

said cutter bearings being adjustably fixed to adequate positions on said movable template, each consisting of a plurality of members equipped with cutters and preshaped according to a desired pattern of paperboard to be cut; and said movable template being driven by said anti-slip leather belts and said fastening belt together to reciprocally move over said two locating tables and pass through gap between said upper and said lower cylindrical rollers when said motor being started, allowing paperboard on said cutter bearings to pass and be pressed by said upper and said lower cylindrical rollers to form said desired pattern.

2. A paperboard cutting machine as claimed in claim 1, wherein said main unit has a control box set thereon with wiring for controlling the positive or reverse turning or stop of said motor; and said two locating tables each having an electric eye provided thereon at proper place for sensing movement of said movable template across said electric eye and sending signal to said control box to cause said movable template to stop and move again in reverse direction after a preset period of time.

3. A paperboard cutting machine as claimed in claim 1, wherein said cutter bearings are replaceable according to different patterns of paperboard to be cut and have locating members made of sponge material provided at two outer cutter bearings for fixing paperboard thereon.

* * * * *